US010482888B2

(12) United States Patent
Kastner et al.

(10) Patent No.: US 10,482,888 B2
(45) Date of Patent: Nov. 19, 2019

(54) APPARATUS AND METHOD FOR SPATIAL AUDIO OBJECT CODING EMPLOYING HIDDEN OBJECTS FOR SIGNAL MIXTURE MANIPULATION

(71) Applicant: Fraunhofer-Gesellschaft zur Foerderung der angewandten Forschung e.V., Munich (DE)

(72) Inventors: Thorsten Kastner, Stockheim/Reitsch (DE); Juergen Herre, Erlangen (DE); Falko Ridderbusch, Erlangen (DE); Cornelia Falch, Rum (AT)

(73) Assignee: FRAUNHOFER-GESELLSCHAFT ZUR FOERDERUNG DER ANGEWANDTEN FORSCHUNG E.V., Munich (DE)

( * ) Notice: Subject to any disclaimer, the term of this patent is extended or adjusted under 35 U.S.C. 154(b) by 0 days.

(21) Appl. No.: 14/760,857

(22) Filed: Jul. 14, 2015

(65) Prior Publication Data

US 2015/0348559 A1 Dec. 3, 2015

Related U.S. Application Data

(63) Continuation of application No. PCT/EP2014/051046, filed on Jan. 20, 2014.

(30) Foreign Application Priority Data

Jan. 22, 2013 (EP) ..... 13152197

(51) Int. Cl.
*G10L 19/008* (2013.01)

(52) U.S. Cl.
CPC ..... *G10L 19/008* (2013.01); *H04S 2400/11* (2013.01); *H04S 2420/03* (2013.01)

(58) Field of Classification Search
CPC .... G10L 19/008; G10L 19/04; H04S 2400/11; H04S 2420/03
(Continued)

(56) References Cited

U.S. PATENT DOCUMENTS 8,095,358 B2 * 1/2012 Pang ..... G10L 19/008 704/201
8,325,929 B2 * 12/2012 Koppens ..... G10L 19/008 381/1
(Continued)

FOREIGN PATENT DOCUMENTS

CN 101379555 A 3/2009
CN 102187691 A 9/2011
(Continued)

OTHER PUBLICATIONS

Faller & Baumgarte, "Binural Cue Coding—Part II: Schemes and Applications," IEEE Trans. on Speech and Audio Proc., vol. 11, No. 6, Nov. 2003.
(Continued)

*Primary Examiner* — Martin Lerner
(74) *Attorney, Agent, or Firm* — Squire Patton Boggs (US) LLP

(57) ABSTRACT

An apparatus for encoding one or more audio objects to obtain an encoded signal is provided. The apparatus includes a for downmixing the one or more audio objects to obtain one or more unprocessed downmix signals. Moreover, the apparatus includes a processing module and a signal calculator. The signal calculator is configured to calculate each of one or more additional signals based on a difference between one of one or more processed downmix signals and one of the one or more unprocessed downmix signals. Moreover, the apparatus includes an object information generator. Furthermore, the apparatus includes an output interface for
(Continued)

outputting the encoded signal. Moreover, a corresponding apparatus for decoding is provided.

14 Claims, 11 Drawing Sheets

(58) Field of Classification Search
USPC ..... 704/500, 501, 502, 220; 381/1, 17
See application file for complete search history.

(56) References Cited

U.S. PATENT DOCUMENTS

| | | | | |
|---|---|---|---|---|
| 8,396,575 | B2 * | 3/2013 | Kraemer | G10L 19/00 700/94 |
| 8,958,566 | B2 * | 2/2015 | Hellmuth | G10L 19/008 381/22 |
| 9,196,257 | B2 * | 11/2015 | Schultz-Amling | G10L 19/173 |
| 9,245,530 | B2 * | 1/2016 | Herre | G10L 19/008 |
| 9,330,671 | B2 * | 5/2016 | Norvell | G10L 19/008 |
| 2006/0190247 | A1 * | 8/2006 | Lindblom | G10L 19/008 704/230 |
| 2009/0012796 | A1 | 1/2009 | Jung et al. | |
| 2009/0125313 | A1 * | 5/2009 | Hellmuth | G10L 19/008 704/501 |
| 2009/0164221 | A1 * | 6/2009 | Kim | G10L 19/008 704/500 |
| 2009/0164227 | A1 | 6/2009 | Oh et al. | |
| 2010/0010821 | A1 * | 1/2010 | Oh | G10L 19/008 704/500 |
| 2010/0106270 | A1 * | 4/2010 | Oh | G10L 19/008 700/94 |
| 2011/0013790 | A1 * | 1/2011 | Hilpert | G10L 19/008 381/300 |
| 2011/0040566 | A1 | 2/2011 | Moon et al. | |
| 2011/0103592 | A1 * | 5/2011 | Kim | G10L 19/008 381/22 |
| 2011/0166867 | A1 | 7/2011 | Seo et al. | |
| 2011/0264456 | A1 * | 10/2011 | Koppens | G10L 19/008 704/500 |
| 2012/0163608 | A1 | 6/2012 | Kishi et al. | |
| 2012/0177204 | A1 * | 7/2012 | Hellmuth | G10L 19/008 381/22 |
| 2014/0019145 | A1 | 1/2014 | Moriya et al. | |
| 2014/0350944 | A1 * | 11/2014 | Jot | G10L 19/008 704/500 |
| 2015/0162012 | A1 * | 6/2015 | Kastner | G10L 19/008 704/500 |

FOREIGN PATENT DOCUMENTS

| | | | |
|---|---|---|---|
| CN | 103460287 | A | 12/2013 |
| EP | 1 292 036 | A2 | 3/2003 |
| EP | 2535892 | A1 | 12/2012 |
| EP | 2690622 | A1 | 1/2014 |
| JP | 2003-332914 | | 11/2003 |
| RU | 2376726 | C2 | 2/2006 |
| RU | 2407227 | C2 | 4/2007 |
| WO | WO 2010/105695 | A1 | 9/2010 |
| WO | WO 2010/125228 | A1 | 11/2010 |
| WO | 2012-137617 | | 10/2012 |

OTHER PUBLICATIONS

Grin & Pinel, "Informed Audio Source Separation from Compressed Linear Stereo Mixtures," AES 42nd International Conference: Semantic Audio, 2011.
Herre et al., "From SAC to SAOC—Recent Developments in Parametric Coding of Spatial Audio," 22nd Regional UK, AES Conference, Cambridge, UK, Apr. 2007.
Engdegard et al., "Spatial Audio Object Coding (SAOC)—The Upcoming MPEG Standard on Parametric Object Based Audio Coding," 124th AES Convention, Amsterdam 2008.
Liutkus et al., "Informed Source Separation through Spectrogram Coding and Data Embedding," Signal Processing Journal, 2011.
Faller, "Parametric Joint-Coding of Audio Sources," 120th AES Convention, Paris, 2006.
Parvaix, "A Watermarking-Based Method for Informed Source Separation of Audio Signals with a Single Sensor," IEEE Transactions on Audio, Speech and Language Processing, 2010.
ISO/IEC, "MPEG Audio Technologies—Part 2: Spatial Audio Object Coding (SAOC)," ISO/IEC JTCI/SC29/WG1 | (MPEG) International Standard 23003-2, Oct. 1, 2010 (First Edition).
Ozerov et al., "Informed Source Separation: Source Coding Meets Source Separation," IEEE Workshop on Applications of Signal Processing to Audio and Acoustics, 2011.
Parvaix & Girin, "Informed Source Separation of Underdetermined Instantaneous Stereo Mixtures Using Source Index Embedding," IEEE ICASSP, 2010.
Zhang & Girin, "An Informed Source Separation System for Speech Signals," Interspeech, 2011.
Office Action issued by the European Patent Office, dated Dec. 6, 2016 for related European Patent Appl. No. 14 700 929.4-1910.
Office Action dated May 20, 2015, issued by the Russian Patent Office for related Russian patent application No. 2015135593.
Notification of Reasons for Refusal dated Nov. 1, 2016 by the Japanese Patent Office.
"Decision to Grant a Patent" dated Apr. 25, 2017, by the Korean Intellectual Property Office.
Herre et al. "MPEG Spatial Audio Object Coding—The ISO/MPEG Standard for Efficient Coding of Interactive Audio Scenes", Journal Audio Engineering Society, vol. 60, No. 9, Sep. 2012.
Chinese Office Action issued in corresponding Chinese Patent Application No. 2014800057385 dated Mar. 13, 2018.

* cited by examiner

APPARATUS AND METHOD FOR SPATIAL AUDIO OBJECT CODING EMPLOYING HIDDEN OBJECTS FOR SIGNAL MIXTURE MANIPULATION

CROSS-REFERENCE TO RELATED APPLICATIONS

This application is a continuation of copending International Application No. PCT/EP2014/051046, filed Jan. 20, 2014, which is incorporated herein by reference in its entirety, and additionally claims priority from European Application No. EP 13152197.3, filed Jan. 22, 2013, which is also incorporated herein by reference in its entirety.

BACKGROUND OF THE INVENTION

The present invention relates to audio signal processing and, in particular, to a decoder, an encoder, a system, methods and a computer program for spatial audio object coding employing hidden objects for signal mixture manipulation.

Audio signal processing becomes more and more important. Recently, parametric techniques for bitrate-efficient transmission and/or storage of audio scenes containing multiple audio objects have been proposed in the field of audio coding [BCC, JSC, SAOC, SAOC1, SAOC2] and, moreover, in the field of informed source separation [ISS1, ISS2, ISS3, ISS4, ISS5, ISS6]. These techniques aim at reconstructing a desired output audio scene or a desired audio source object on the basis of additional side information describing the transmitted and/or stored audio scene and/or the audio source objects in the audio scene.

FIG. 11 depicts a system according to the state of the art illustrating the example of MPEG SAOC (MPEG=Moving Picture Experts Group; SAOC=Spatial Audio Object Coding). In particular, FIG. 11 illustrates an MPEG SAOC system overview.

According to the state of the art, general processing is often carried out in a frequency selective way and can, for example, be described as follows within each frequency band:

N input audio object signals $s_1 \ldots s_N$ are mixed down to P channels $x_1 \ldots x_P$ as part of the processing of a mixer 912 of a state-of-the-art SAOC encoder 910. A downmix matrix may be employed comprising the elements $d_{1,1}, \ldots, d_{N,P}$. In addition, a side information estimator 914 of the SAOC encoder 910 extracts side information describing the characteristics of the input audio objects. For MPEG SAOC, the relations of the object powers with respect to each other are a basic form of such a side information.

Subsequently, downmix signal(s) and side information may be transmitted and/or stored. To this end, the downmix audio signal may be encoded, e.g. compressed, by a state-of-the-art perceptual audio coder 920, such as an MPEG-1 Layer II or III (also known as mp3) audio coder or an MPEG Advanced Audio Coding (AAC) audio coder, etc.

On the receiving end, the encoded signals may, at first, be decoded, e.g., by a state-of-the-art perceptual audio decoder 940, such as an MPEG-1 Layer II or III audio decoder, an MPEG Advanced Audio Coding (AAC) audio decoder.

Then, a state-of-the-art SAOC decoder 950 conceptually tries to restore the original object signals, e.g., by conducting "object separation", from the (decoded) downmix signals using the transmitted side information which, e.g., may have been generated by a side information estimator 914 of a SAOC encoder 910, as explained above. For the purpose of restoring the original object signals by conducting object separation, the SAOC decoder 950 comprises an object separator 952, e.g. a virtual object separator.

The object separator 952 may then provide the approximated object signals $\hat{s}_1, \ldots, \hat{s}_n$ to a renderer 954 of the SAOC decoder 950, wherein the renderer 954 then mixes the approximated object signals $\hat{s}_1, \ldots, \hat{s}_n$ into a target scene represented by M audio output channels $\hat{y}_1, \ldots, \hat{y}_M$, for example, by employing a rendering matrix. The coefficients $r_{1,1} \ldots r_{N,M}$ in FIG. 11 may, e.g., indicate some of the coefficients of the rendering matrix. The desired target scene may, in a special case, be the rendering of only one source signal out of the mixture (source separation scenario), but may also be any other arbitrary acoustic scene.

However, the processing according to the state of the art has several drawbacks:

The state-of-the-art systems are restricted to processing of audio source signals only. Signal processing in the encoder and the decoder is carried out under the assumption, that no further signal processing is applied to the mixture signals or to the original source object signals. The performance of such systems decreases if this assumption does not hold any more.

A prominent example, which violates this assumption, is the usage of an audio coder in the processing chain to reduce the amount of data to be stored and/or transmitted for efficiently carrying the downmix signals. The signal compression perceptually alters the downmix signals. This has the effect that the performance of the object separator in the decoding system decreases and thus the perceived quality of the rendered target scene decreases as well [ISS5, ISS6].

SUMMARY

According to an embodiment, an apparatus for decoding an encoded signal may have: an interface for receiving one or more processed downmix signals, and for receiving the encoded signal, wherein the one or more processed downmix signals encode one or more unprocessed downmix signals, and wherein the encoded signal includes audio object information on one or more audio objects, and additional parametric information, wherein the additional parametric information parameterizes one or more additional signals, wherein each of the one or more additional signals results from generating, by an apparatus for encoding, a difference signal between one of the one or more first decoded signals and one of the one or more unprocessed signals, wherein the one or more first decoded signals result from decoding, by the apparatus for encoding, the one or more processed signals, an audio decoder for decoding the one or more processed downmix signals to obtain one or more second decoded signals, and an audio scene generator for generating an audio scene including a plurality of spatial audio signals based on the one or more second decoded signals, the parametric audio object information, the additional parametric information, and rendering information indicating a placement of the one or more audio objects in the audio scene, wherein the audio scene generator is configured to attenuate or eliminate an output signal represented by the additional parametric information in the audio scene.

According to another embodiment, an apparatus for encoding one or more audio objects to obtain an encoded signal may have: a downmixer for downmixing the one or more audio objects to obtain one or more unprocessed downmix signals, a processing module for processing the one or more unprocessed downmix signals to obtain one or more processed downmix signals, wherein the processing module is configured to process the one or more unprocessed downmix signals by encoding the one or more unprocessed downmix signals to obtain the one or more processed downmix signals, a signal calculator for calculating one or more additional signals, wherein the signal calculator includes a decoding unit and a combiner, wherein the decoding unit is configured to decode the one or more processed downmix signals to obtain one or more decoded signals, and wherein the combiner is configured to generate each of the one or more additional signals by generating a difference signal between one of the one or more decoded signals and one of the one or more unprocessed downmix signals, an object information generator for generating parametric audio object information for the one or more audio objects and additional parametric information for the one or more additional signals, and an output interface for outputting the encoded signal, the encoded signal including the parametric audio object information for the one or more audio objects and the additional parametric information for the one or more additional signals.

According to another embodiment, a system may have: an inventive apparatus for encoding, and an inventive apparatus for decoding, wherein the inventive apparatus for encoding is configured to provide one or more processed downmix signals and an encoded signal to the inventive apparatus for decoding, the encoded signal including parametric audio object information for one or more audio objects and additional parametric information for one or more additional signals, and wherein the inventive apparatus for decoding is configured to generate an audio scene including a plurality of spatial audio signals based on the parametric audio object information, the additional parametric information, and rendering information indicating a placement of the one or more audio objects in the audio scene.

According to another embodiment, a method for decoding an encoded signal may have the steps of: receiving one or more processed downmix signals, and for receiving the encoded signal, wherein the one or more processed downmix signals encode one or more unprocessed downmix signals, and wherein the encoded signal includes audio object information on one or more audio objects, and additional parametric information, wherein the additional parametric information parameterizes one or more additional signals, wherein each of the one or more additional signals results from generating, by an apparatus for encoding, a difference signal between one of the one or more first decoded signals and one of the one or more unprocessed signals, wherein the one or more first decoded signals result from decoding, by the apparatus for encoding, the one or more processed signals, decoding the one or more processed downmix signals to obtain one or more second decoded signals, and generating an audio scene including a plurality of spatial audio signals based on the one or more second decoded signals, the parametric audio object information, the additional parametric information, and rendering information indicating a placement of the one or more audio objects in the audio scene, wherein generating the audio scene is conducted by attenuating or eliminating an output signal represented by the additional parametric information in the audio scene.

According to another embodiment, a method for encoding one or more audio objects to obtain an encoded signal may have the steps of: downmixing the one or more audio objects to obtain one or more unprocessed downmix signals, processing the one or more unprocessed downmix signals to obtain one or more processed downmix signals, wherein processing the one or more unprocessed downmix signals is conducted by encoding the one or more unprocessed downmix signals to obtain the one or more processed downmix signals, calculating one or more additional signals by decoding the one or more processed downmix signals to obtain one or more decoded signals, and by generating each of the one or more additional signals by generating a difference signal between one of the one or more decoded signals and one of the one or more unprocessed downmix signals, generating parametric audio object information for the one or more audio objects and additional parametric information for the one or more additional signals, and outputting the encoded signal, the encoded signal including the parametric audio object information for the one or more audio objects and the additional parametric information for the one or more additional signals.

Another embodiment may have a computer program for implementing the inventive methods when being executed on a computer or signal processor.

An apparatus for encoding one or more audio objects to obtain an encoded signal is provided. The apparatus comprises a downmixer for downmixing the one or more audio objects to obtain one or more unprocessed downmix signals. Moreover, the apparatus comprises a processing module for processing the one or more unprocessed downmix signals to obtain one or more processed downmix signals. Furthermore, the apparatus comprises a signal calculator for calculating one or more additional signals, wherein the signal calculator is configured to calculate each of the one or more additional signals based on a difference between one of the one or more processed downmix signals and one of the one or more unprocessed downmix signals. Moreover, the apparatus comprises an object information generator for generating parametric audio object information for the one or more audio objects and additional parametric information for the additional signal. Furthermore, the apparatus comprises an output interface for outputting the encoded signal, the encoded signal comprising the parametric audio object information for the one or more audio objects and the additional parametric information for the one or more additional signals.

According to an embodiment, the processing module may be configured to process the one or more unprocessed downmix signals by encoding the one or more unprocessed downmix signals to obtain the one or more processed downmix signals.

In an embodiment, the signal calculator may comprise a decoding unit and a combiner. The decoding unit may be configured to decode the one or more processed downmix signals to obtain one or more decoded signals. Moreover, the combiner may be configured to generate each of the one or more additional signals by generating a difference signal between one of the one or more decoded signals and one of the one or more unprocessed downmix signals.

According to an embodiment, each of the one or more unprocessed downmix signals may comprise a plurality of first signal samples, each of the first signal samples being assigned to one of a plurality of points-in-time. Each of the one or more decoded signals may comprise a plurality of second signal samples, each of the second signal samples being assigned to one of the plurality of points-in-time. The signal calculator may furthermore comprise a time alignment unit being configured to time-align one of the one or more decoded signals and one of the one or more unprocessed downmix signals, so that one of the first signal samples of said unprocessed downmix signal is assigned to one of the second signal samples of said decoded signal, said first signal sample of said unprocessed downmix signal and said second signal sample of said decoded signal being assigned to the same point-in-time of the plurality of points-in-time.

In an embodiment, the processing module may be configured to process the one or more unprocessed downmix signals by applying an audio effect on at least one of the one or more unprocessed downmix signals to obtain the one or more processed downmix signals.

According to an embodiment, an audio object energy value may be assigned to each one of the one or more audio objects, and an additional energy value may be assigned each one of the one or more additional signals. The object information generator may be configured to determine a reference energy value, so that the reference energy value is greater than or equal to the audio object energy value of each of the one or more audio objects, and so that the reference energy value is greater than or equal to the additional energy value of each of the one or more additional signals. Moreover, the object information generator may be configured to determine the parametric audio object information by determining an audio object level difference for each audio object of the one or more audio objects, so that said audio object level difference indicates a ratio of the audio object energy value of said audio object to the reference energy value, or so that said audio object level difference indicates a difference between the reference energy value and the audio object energy value of said audio object. Furthermore, the object information generator may be configured to determine the additional object information by determining an additional object level difference for each additional signal of the one or more additional signals, so that said additional object level difference indicates a ratio of the additional energy value of said additional signal to the reference energy value, or so that said additional object level difference indicates a difference between the reference energy value and the additional energy value of said additional signal.

In an embodiment, the processing module may comprise an acoustic effect module and an encoding module. The acoustic effect module may be configured to apply an acoustic effect on at least one of the one or more unprocessed downmix signals to obtain one or more acoustically adjusted downmix signals. Moreover, the encoding module may be configured to encode the one or more acoustically adjusted downmix signals to obtain the one or more processed signals.

Furthermore, an apparatus for decoding an encoded signal is provided, wherein the encoded signal comprises parametric audio object information on one or more audio objects, and additional parametric information. The apparatus comprises an interface for receiving one or more processed downmix signals, and for receiving the encoded signal, wherein the additional parametric information reflects a processing performed on one or more unprocessed downmix signals to obtain the one or more processed downmix signals. Moreover, the apparatus comprises an audio scene generator for generating an audio scene comprising a plurality of spatial audio signals based on the one or more processed downmix signals, the parametric audio object information, the additional parametric information, and rendering information indicating a placement of the one or more audio objects in the audio scene, wherein the audio scene generator is configured to attenuate or eliminate an output signal represented by the additional parametric information in the audio scene.

According to an embodiment, the additional parametric information may depend on one or more additional signals, wherein the additional signals indicate a difference between one of the one or more processed downmix signals and one of the one or more unprocessed downmix signals, wherein the one or more unprocessed downmix signals indicate a downmix of the one or more audio objects, and wherein the one or more processed downmix signals result from the processing of the one or more unprocessed downmixed signals.

In an embodiment, the audio scene generator may comprise an audio object generator and a renderer. The audio object generator may be configured to generate the one or more audio objects based on the one or more processed downmix signals, the parametric audio object information and the additional parametric information. The renderer may be configured to generate the plurality of spatial audio signals of the audio scene based on the one or more audio objects, the parametric audio object information and rendering information.

According to an embodiment, the renderer may be configured to generate the plurality of spatial audio signals of the audio scene based on the one or more audio objects, the additional parametric information, and the rendering information, wherein the renderer may be configured to attenuate or eliminate the output signal represented by the additional parametric information in the audio scene depending on one or more rendering coefficients comprised by the rendering information.

In an embodiment, the apparatus may further comprise a user interface for setting the one or more rendering coefficients for steering whether the output signal represented by the additional parametric information is attenuated or eliminated in the audio scene.

According to an embodiment, the audio scene generator may be configured to generate the audio scene comprising a plurality of spatial audio signals based on the one or more processed downmix signals, the parametric audio object information, the additional parametric information, and rendering information indicating a placement of the one or more audio objects in the audio scene, wherein the audio scene generator may be configured to not generate the one or more audio objects to generate the audio scene.

In an embodiment, the apparatus may furthermore comprise an audio decoder for decoding the one or more processed downmix signals to obtain one or more decoded signals, wherein the audio scene generator may be configured to generate the audio scene comprising the plurality of spatial audio signals based on the one or more decoded signals, the parametric audio object information, the additional parametric information, and the rendering information.

In another embodiment, the audio scene generator may be configured to generate the audio scene by employing the formulae $$\hat{Y}=R'\hat{S}',$$

$$\hat{S}'=G'X',$$

$$G'=E'D'^{T}(D'E'D'^{T})^{-1}, \text{ and}$$

wherein $\hat{Y}$ is a first matrix indicating the audio scene, wherein $\hat{Y}$ comprises a plurality of rows indicating the plurality of spatial audio signals, wherein R' is a second matrix indicating the rendering information, wherein $\hat{S}'$ is a third matrix, wherein X' is a fourth matrix indicating the one or more processed downmix signals, wherein G' is a fifth matrix, wherein D' is a sixth matrix, being a downmix matrix, and wherein E' is a seventh matrix comprising a plurality of seventh matrix coefficients, wherein the seventh matrix coefficients are defined by the formula:

$$E'_{i,j}=IOC'_{i,j}\sqrt{OLD'_i OLD'_j},$$

wherein $E'_{i,j}$ is one of the seventh matrix coefficients at row i and column j, i being a row index and j being a column index, wherein $IOC'_{i,j}$ indicates a cross correlation value, and wherein $OLD'_i$ indicates a first energy value, and wherein $OLD'_j$ indicates a second energy value.

Furthermore, a system is provided. The system comprises an apparatus for encoding according to one of the above-described embodiments, and an apparatus for decoding according to one of the above-described embodiments. The apparatus for encoding is configured to provide one or more processed downmix signals and an encoded signal to the apparatus for decoding, the encoded signal comprising parametric audio object information for one or more audio objects and additional parametric information for one or more additional signals. The apparatus for decoding is configured to generate an audio scene comprising a plurality of spatial audio signals based on the parametric audio object information, the additional parametric information, and rendering information indicating a placement of the one or more audio objects in the audio scene.

Moreover, a method for encoding one or more audio objects to obtain an encoded signal is provided. The method comprises:

- Downmixing the one or more audio objects to obtain one or more unprocessed downmix signals.
- Processing the one or more unprocessed downmix signals to obtain one or more processed downmix signals.
- Calculating one or more additional signals by calculating each of the one or more additional signals based on a difference between one of the one or more processed downmix signals and one of the one or more unprocessed downmix signals.
- Generating parametric audio object information for the one or more audio objects and additional parametric information for the one or more additional signals. And:
- Outputting the encoded signal, the encoded signal comprising the parametric audio object information for the one or more audio objects and the additional parametric information for the one or more additional signals.

Furthermore, a method for decoding an encoded signal, the encoded signal comprising parametric audio object information on one or more audio objects, and additional parametric information is provided. The method comprises:

- Receiving one or more processed downmix signals, and for receiving the encoded signal, wherein the additional parametric information reflects a processing performed on one or more unprocessed downmix signals to obtain the one or more processed downmix signals.
- Generating an audio scene comprising a plurality of spatial audio signals based on the one or more processed downmix signals, the parametric audio object information, the additional parametric information, and rendering information indicating a placement of the one or more audio objects in the audio scene. And:
- Attenuating or eliminating an output signal represented by the additional parametric information in the audio scene.

Moreover, a computer program for implementing one of the above-described methods, when being executed on a computer or signal processor, is provided.

According to embodiments, concepts of parametric object coding are improved/extended by providing alterations/manipulations of the source object or mixture signals as additional hidden objects. Including these hidden objects in the side info estimation process and in the (virtual) object separation results in an improved perceptual quality of the rendered acoustic scene. The hidden objects can, e.g., describe artificially generated signals like the coding error signal from a perceptual audio coder that are applied to the downmix signals, but can, e.g., also be a description of other non-linear processing that is applied to the downmix signals, for example, reverberation.

Due to the character of these hidden objects, they are primarily not intended to be rendered at the decoding side, but used to improve the (virtual) object separation process and thus improving the perceived quality of the rendered acoustic scene. This is achieved by rendering the hidden object(s) with a reproduction level of zero ("muting"). In this way, the rendering process in the decoder is automatically controlled such that it tends to suppress the undesired components represented by the hidden object(s) and thus improve the subjective quality of the rendered scene/signal.

According to an embodiment, the encoding module may be a perceptual audio encoder.

The provided concepts are inter alia advantageous as they are able to provide an improvement in audio quality by including hidden object information in a fully decoder-compatible way. This means that the described improvements in output signal quality can be obtained without any need to change existing/deployed (e.g. SAOC) decoders which have been standardized under ISO/MPEG, and cannot be changed without violating conformance to the standard SAOC specification (or re-issuing the standard which would be a time-consuming and costly process).

In the following, reference will be made to "hidden objects". It should be noted that in some embodiments, additional parametric information may, for example, represent one or more hidden objects.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
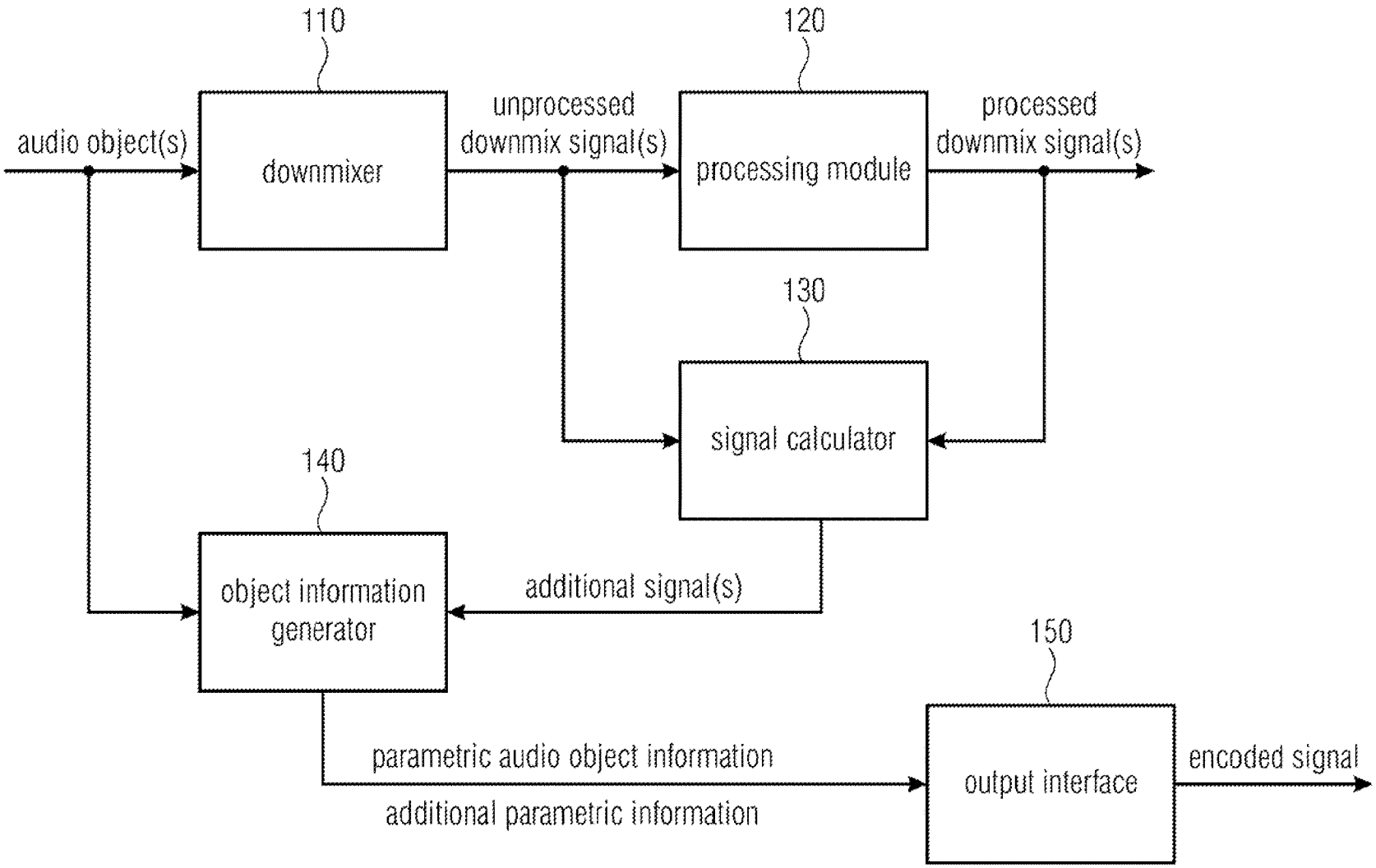
FIG. 1 illustrates an apparatus for encoding one or more audio objects to obtain an encoded signal according to an embodiment.

FIG. 1 illustrates an apparatus for encoding one or more audio objects to obtain an encoded signal according to an embodiment.

The apparatus comprises a downmixer 110 for downmixing the one or more audio objects to obtain one or more unprocessed downmix signals. For this purpose, the downmixer of FIG. 1 receives the one or more audio objects and downmixes them, e.g. by applying a downmix matrix to obtain the one of more unprocessed downmix signals.

Moreover, the apparatus comprises a processing module 120 for processing the one or more unprocessed downmix signals to obtain one or more processed downmix signals. The processing module 120 receives the one or more unprocessed downmix signals from the down mixer and processes them to obtain the one or more processed signals.

For example, the processing module 120 may be an encoding module, e.g. a perceptual encoder, and may be configured to process the one or more unprocessed downmix signals by encoding the one or more unprocessed downmix signals to obtain the one or more processed downmix signals. The processing module 120 may, for example, be a perceptual audio encoder, e.g., an MPEG-1 Layer II or III (also known as mp3) audio coder or an MPEG Advanced Audio Coding (AAC) audio coder, etc.

Or, for example, the processing module 120 may be an audio effect module and may be configured to process the one or more unprocessed downmix signals by applying an audio effect on at least one of the one or more unprocessed downmix signals to obtain the one or more processed downmix signals.

Furthermore, the apparatus comprises a signal calculator 130 for calculating one or more additional signals. The signal calculator 130 is configured to calculate each of the one or more additional signals based on a difference between one of the one or more processed downmix signals and one of the one or more unprocessed downmix signals.

The signal calculator 130 may, for example, calculate a difference signal between one of the one or more processed downmix signals and one of the one or more unprocessed downmix signals to generate the one of the one or more additional signals.

However, in other embodiments, the signal calculator 130 may, instead of determining a difference signal, determine any other kind of difference between said one of the one or more processed downmix signals and said one of the one or more unprocessed downmix signals to generate the one of the one or more additional signals. The signal calculator 130 may then calculate an additional signal based on the determined difference between the two signals.

Moreover, the apparatus comprises an object information generator 140 for generating parametric audio object information for the one or more audio objects and additional parametric information for the additional signal.

For example, to determine parametric audio object information and the additional parametric information object level differences may be determined. For example, an audio object energy value may be assigned to each one of the one or more audio objects, and an additional energy value may be assigned each one of the one or more additional signals.

The object information generator 140 may be configured to determine a reference energy value, so that the reference energy value is greater than or equal to the audio object energy value of each of the one or more audio objects, and so that the reference energy value is greater than or equal to the additional energy value of each of the one or more additional signals.

Moreover, the object information generator 140 may be configured to determine the parametric audio object information by determining an audio object level difference for each audio object of the one or more audio objects, so that said audio object level difference indicates a ratio of the audio object energy value of said audio object to the reference energy value, or so that said audio object level difference indicates a difference between the reference energy value and the audio object energy value of said audio object.

Furthermore, the object information generator 140 may be configured to determine the additional object information by determining an additional object level difference for each additional signal of the one or more additional signals, so that said additional object level difference indicates a ratio of the additional energy value of said additional signal to the reference energy value, or so that said additional object level difference indicates a difference between the reference energy value and the additional energy value of said additional signal.

For example the audio object energy value of each of the audio objects may be passed to the object information generator 140 as side information. The energy value of each of the additional signals may also be passed to the object information generator 140 as side information. Or, in other embodiments, the object information generator 140 may itself calculate the energy values of each of the additional signals, for example, by squaring each of the sample values of one of the additional signals, by summing up said sample values to obtain an intermediate result, and by calculating the square root of the intermediate result to obtain the energy value of said additional signal. The object information generator 140 may then, for example, determine the greatest energy value of all audio objects and all additional signals as the reference energy value.

Then, the object information generator 140 may then e.g. determine the ratio of the additional energy value of an additional signal and the reference energy value as the additional object level difference. For example, if an additional energy value is 3.0 and the reference energy value is 6.0, then the additional object level difference is 0.5.

Alternatively, the object information generator 140 may e.g. determine the difference of the reference energy value and the additional energy value of an additional signal as the additional object level difference. For example, if an additional energy value is 7.0 and the reference energy value is 10.0, then the additional object level difference is 3.0. Calculating the additional object level difference by determining the difference is particularly suitable, if the energy values are expressed with respect to a logarithmic scale.

In other embodiments, the parametric information may also comprise information on an Inter-Object Coherence between spatial audio objects and/or hidden objects.

Furthermore, the apparatus comprises an output interface 150 for outputting the encoded signal. The encoded signal comprises the parametric audio object information for the one or more audio objects and the additional parametric information for the one or more additional signals. For this purpose, in some embodiments, the output interface 150 may be configured to generate the encoded signal such that the encoded signal comprises the parametric audio object information for the one or more audio objects and the additional parametric information for the one or more additional signals. Or, in other embodiments, the object information generator 140 may already generate the encoded signal such that the encoded signal comprises the parametric audio object information for the one or more audio objects and the additional parametric information for the one or more additional signals and passes the encoded signal to output interface 150.

Figure 2:
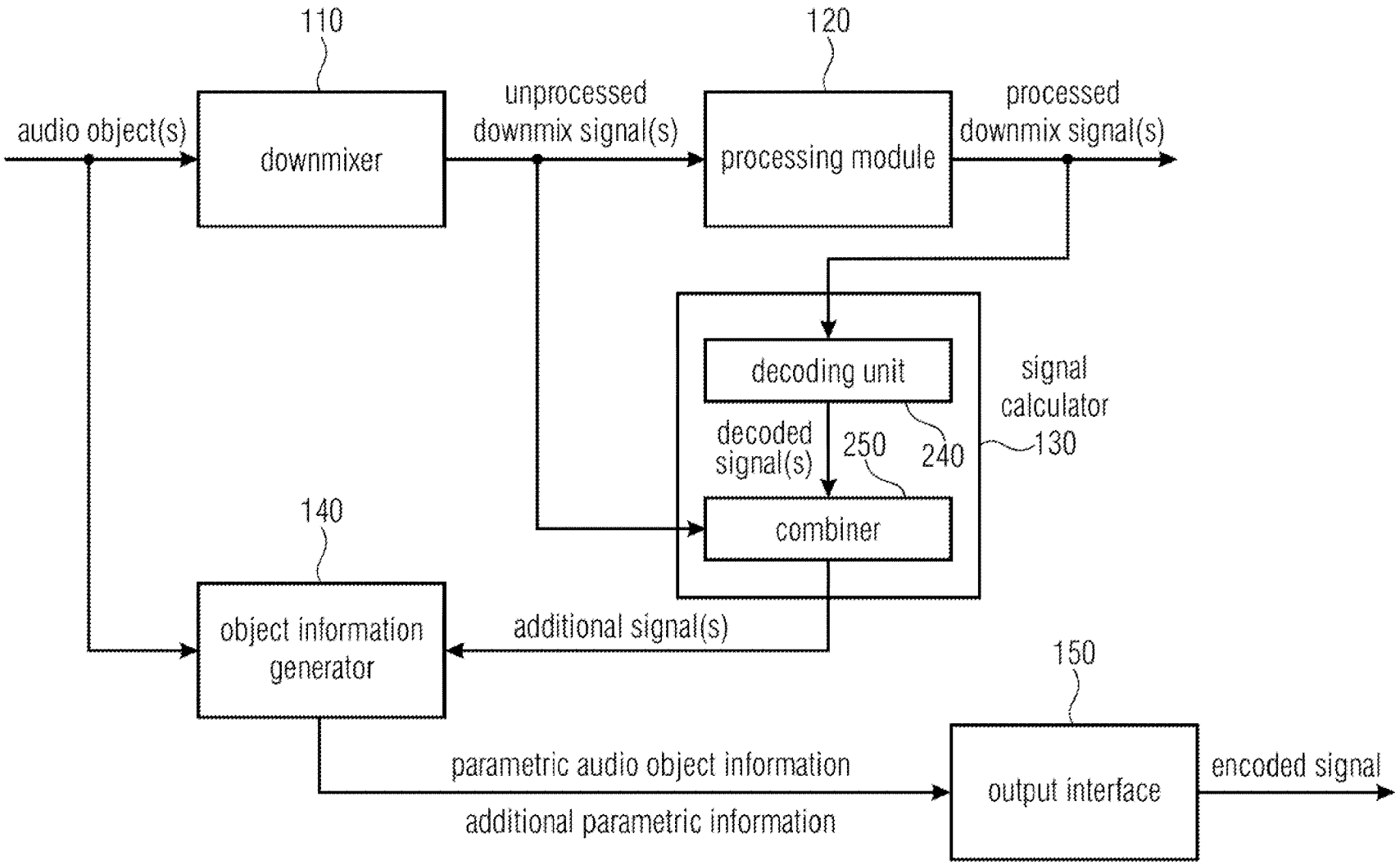
FIG. 2 illustrates an apparatus for encoding one or more audio objects to obtain an encoded signal according to another embodiment.

FIG. 2 illustrates an apparatus for encoding one or more audio objects to obtain an encoded signal according to another embodiment. In the embodiment of FIG. 2, the processing module 120 is configured to process the one or more unprocessed downmix signals by encoding the one or more unprocessed downmix signals to obtain the one or more processed downmix signals. The signal calculator 130 of FIG. 2 comprises a decoding unit 240 and a combiner 250. The decoding unit 240 is configured to decode the one or more processed downmix signals to obtain one or more decoded signals. Moreover, the combiner 250 is configured to generate each of the one or more additional signals by generating a difference signal between one of the one or more decoded signals and one of the one or more unprocessed downmix signals.

Embodiments are based on the finding that after spatial audio objects have been downmixed, the resulting downmix signals may be (unintentionally or intentionally) modified by a subsequent processing module. By providing a side information generator which encodes information on the modifications of the downmix signals as hidden object side information, e.g. as hidden objects, such effects can either be removed when reconstructing the spatial audio objects (in particular, when the modifications of the downmix signals were unintentional), or it can be decided, to what degree/to what amount the (intentional) modifications of the downmix signals shall be rendered, when generating audio channels from the reconstructed spatial audio objects.

In the embodiment of FIG. 2, the decoding unit 240 already generates one or more decoded signals on the encoder side so that the one or more decoded signals can be compared with the one or more unprocessed downmix signals to determine a difference caused by the encoding conducted by the processing module 120.

Figure 3:
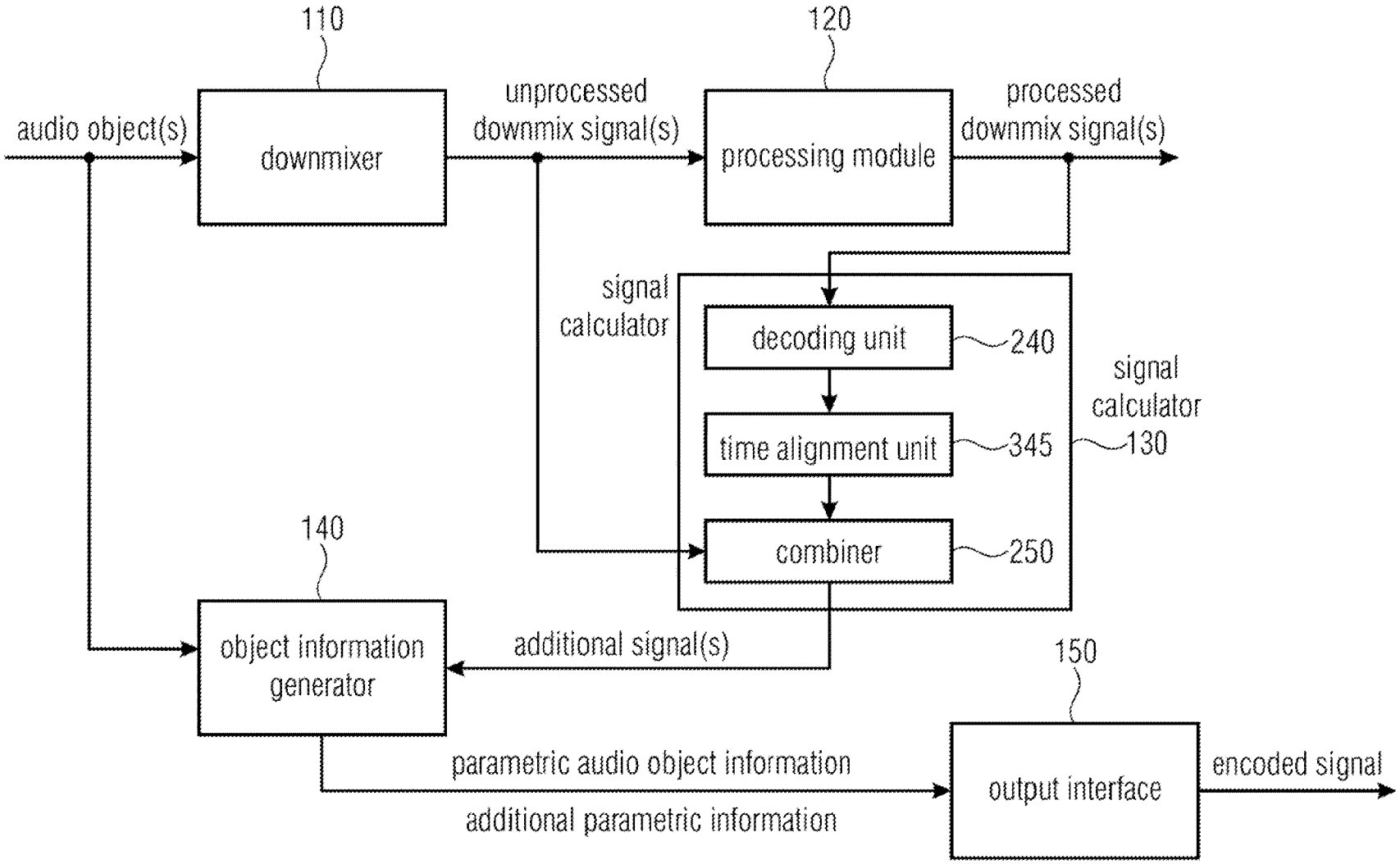
FIG. 3 illustrates an apparatus for encoding one or more audio objects to obtain an encoded signal according to a further embodiment.

FIG. 3 illustrates an apparatus for encoding one or more audio objects to obtain an encoded signal according to a further embodiment. Each of the one or more unprocessed downmix signals may comprise a plurality of first signal samples, each of the first signal samples being assigned to one of a plurality of points-in-time. Each of the one or more decoded signals may comprise a plurality of second signal samples, each of the second signal samples being assigned to one of the plurality of points-in-time.

The embodiment of FIG. 3 differs from the embodiment of FIG. 2 in that the signal calculator furthermore comprises a time alignment unit 345 being configured to time-align one of the one or more decoded signals and one of the one or more unprocessed downmix signals, so that one of the first signal samples of said unprocessed downmix signal is assigned to one of the second signal samples of said decoded signal, said first signal sample of said unprocessed downmix signal and said second signal sample of said decoded signal being assigned to the same point-in-time of the plurality of points-in-time.

In other words, as processing by the processing module 120 and decoding by the decoding unit 240 takes time, the unprocessed downmix signals and the decoded downmix signals should be aligned in time to compare them and to determine differences between them, respectively.

Figure 4:
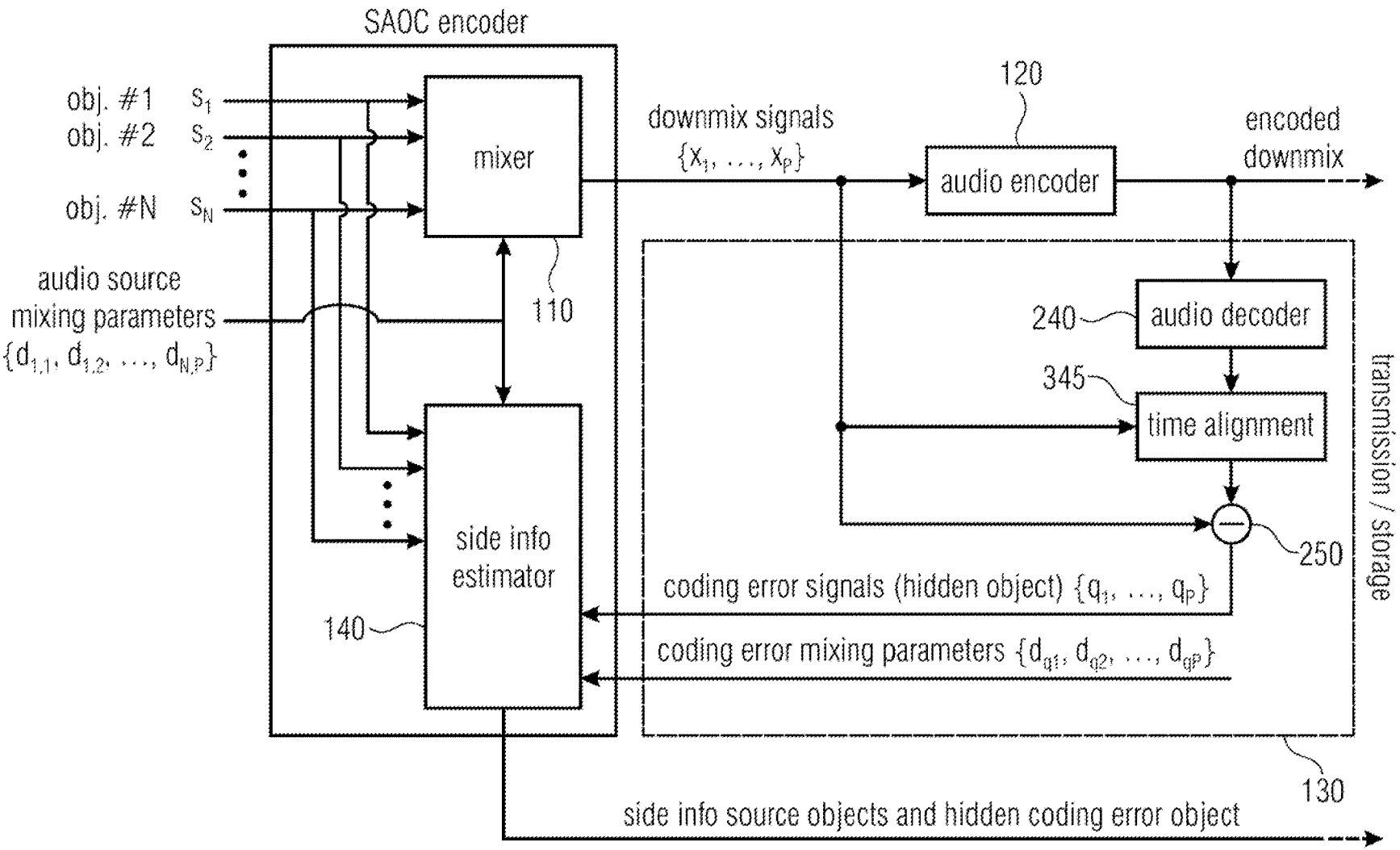
FIG. 4 illustrates an apparatus for encoding one or more audio objects to obtain an encoded signal according to another embodiment.

FIG. 4 illustrates an apparatus for encoding one or more audio objects to obtain an encoded signal according to another embodiment. In particular, FIG. 4 illustrates apparatus for encoding one or more audio objects by generating additional parameter information which parameterizes the one or more additional signals (e.g. one or more coding error signals) by additional parameters. These additional parameters may be referred to as "hidden objects", as on a decoder side, they may be hidden to a user.

The apparatus of FIG. 4 comprises a mixer 110 (a downmixer), an audio encoder as the processing module 120 a signal calculator 130 and an object information generator 140 (which may also be referred to as side information estimator). The signal calculator 130 is indicated by dashed lines and comprises a decoding unit 240 ("audio decoder"), a time alignment unit 345 and a combiner 250.

In the embodiment of FIG. 4, the combiner 250 may, e.g., form at least one difference, e.g. at least one difference signal, between at least one of the (time-aligned) downmix signals and at least one of the (time-aligned) encoded signals. The mixer 110 and the side information estimator 140 may be comprised by a SAOC encoder module.

Perceptual audio codecs produce signal alterations of the downmix signals which can be described by a coding noise signal. This coding noise signal can cause perceivable signal degradations when using the flexible rendering capabilities at the decoding side [ISS5, ISS6]. The coding noise can be described as a hidden object that is not intended to be rendered at the decoding side. It can be parameterized similar to the "real" source object signals.

More specifically, this may, for example, be done as follows:

- The downmix signals are encoded/decoded by the audio codec (or processed by another algorithm) to obtain at least one decoded signal (encoding may, e.g., be conducted by the processing module 120; decoding may, e.g., be conducted by the decoding unit 240).
- The decoded (time-aligned) downmix signals are then subtracted from the (original) dowmmix signals $x_1 \ldots x_P$, resulting in one or more difference signals (being combination signals) which represent one or more coding (processing) error (noise) signals $q_1 \ldots q_P$.
- The error signals $q_1 \ldots q_P$ (difference signals) and the error signal mixing parameters $d_{q,1} \ldots d_{q,P}$ (which are set to 1 by default) are provided to the side information estimator 140 (object analysis part) of a SAOC encoder resulting in the parameter info of the additional (hidden) noise object. For MPEG SAOC, the relations of the object powers (hidden and audio source objects) with respect to each other are computed as the most basic form of such a side information. The additional hidden noise object represents hidden object side information.
- The parameter information of the additional noise object is added to the SAOC side information which had been generated by the SAOC encoder from the actual objects. (The SAOC side information can be considered as audio object side information. Such audio object side information, e.g., describes characteristics of the two or more spatial audio objects based on the two or more spatial audio objects.)

Figure 5:
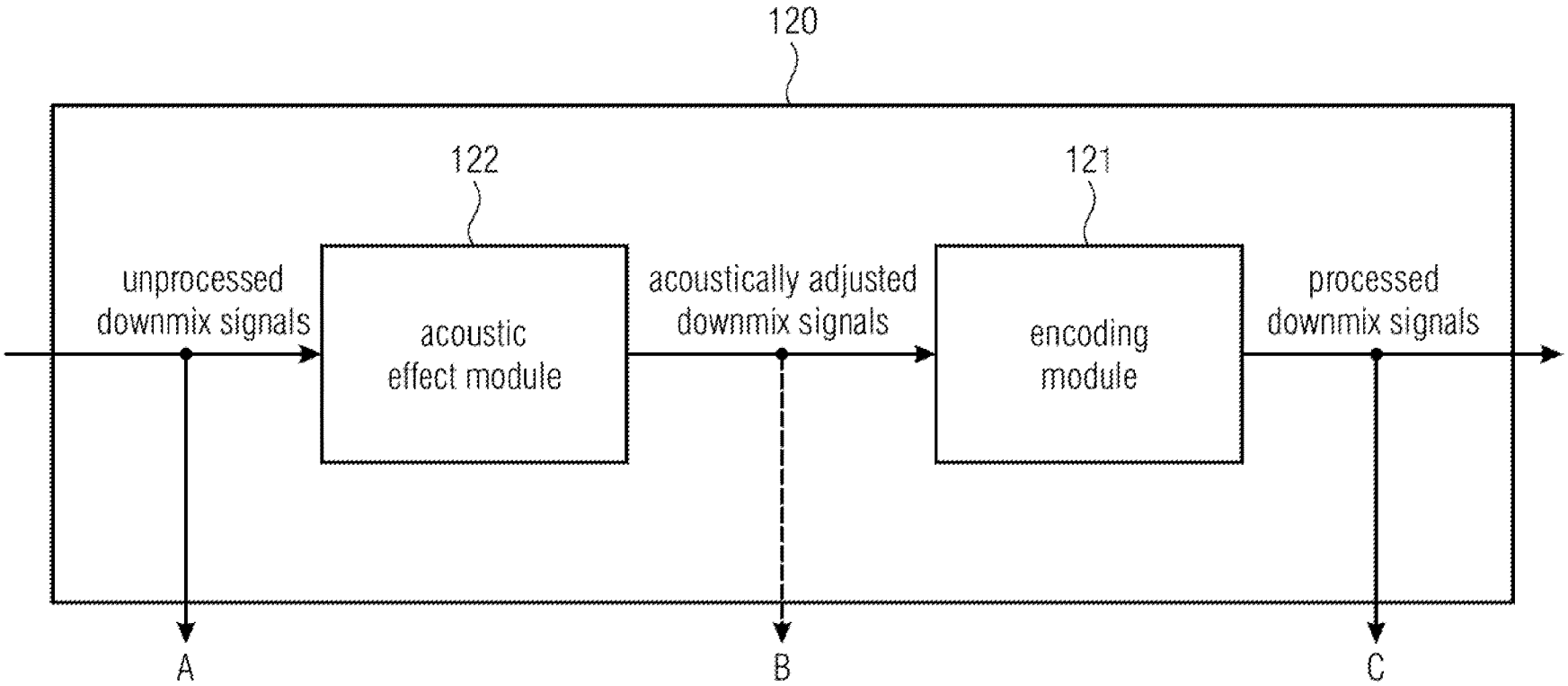
FIG. 5 illustrates a processing module 120 of an apparatus for encoding according to an embodiment.

FIG. 5 illustrates a processing module 120 of an apparatus for encoding according to an embodiment. The processing module 120 comprises an acoustic effect module 122 and an encoding module 121. The acoustic effect module 122 is configured to apply an acoustic effect on at least one of the one or more unprocessed downmix signals to obtain one or more acoustically adjusted downmix signals. Moreover, the encoding module 121 is configured to encode the one or more acoustically adjusted downmix signals to obtain the one or more processed signals.

The signals points A and C may be fed into the object information generator 140. Thus, the object information generator can determine the effect of the acoustic effect module 122 and the encoding module 121 on the unprocessed downmix signal and can generate according additional parametric information to represent that effect.

Optionally, the signal at point B may also be fed into the object information generator 140. By this, the object information generator 140 can determine the individual effect of the acoustic effect module 122 on the unprocessed downmix signal by taking the signals at A and B into account. This can e.g. be realized by forming difference signals between the signals at A and the signals at B.

Moreover, by this, the object information generator 140 can determine the individual effect of the encoding module 121 by taking the signals at B and C into account. This can be realized, e.g., by decoding the signals at point C and by forming difference signals between these decoded signals and the signals at B.

Figure 6:
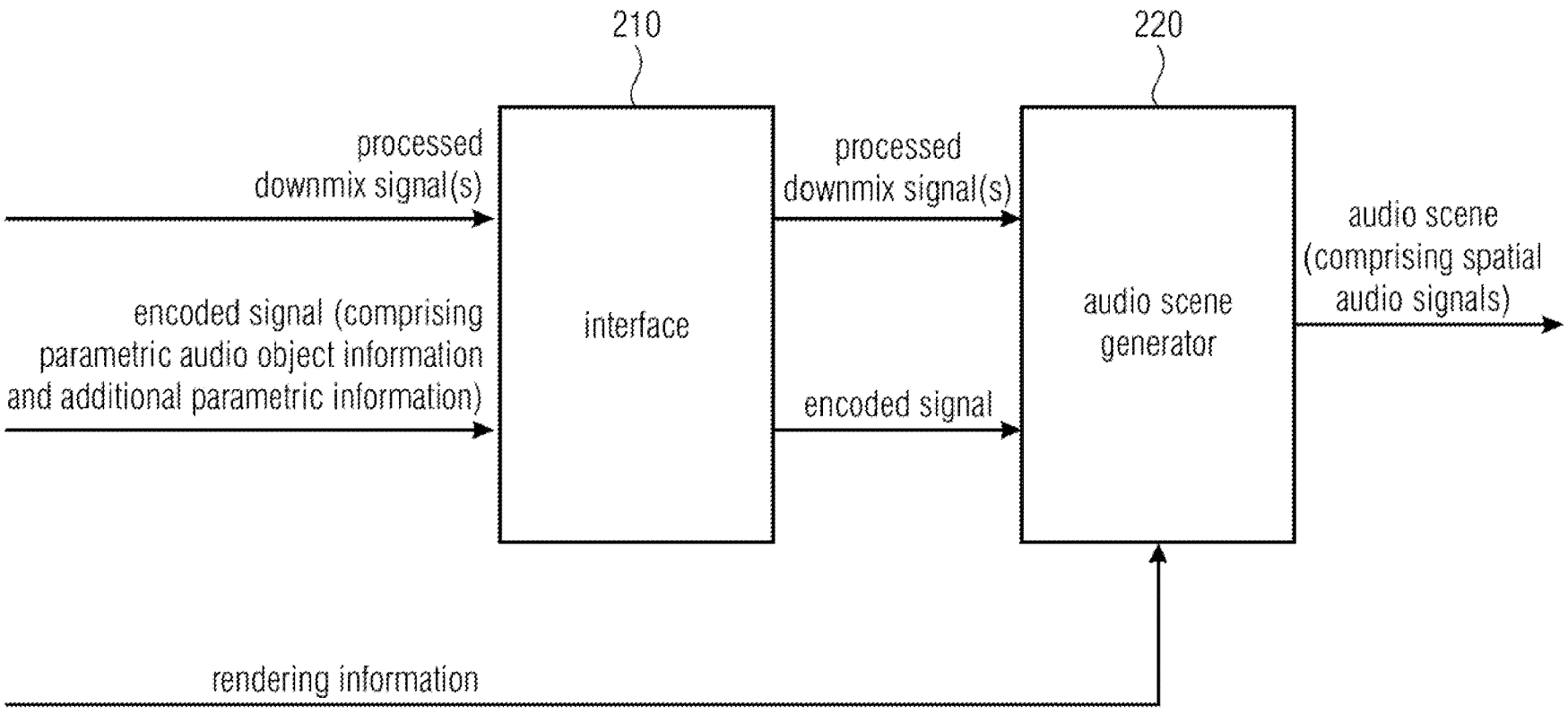
FIG. 6 illustrates an apparatus for decoding an encoded signal according to an embodiment.

FIG. 6 illustrates an apparatus for decoding an encoded signal according to an embodiment. The encoded signal comprises parametric audio object information on one or more audio objects, and additional parametric information.

The apparatus comprises an interface 210 for receiving one or more processed downmix signals, and for receiving the encoded signal. The additional parametric information reflects a processing performed on one or more unprocessed downmix signals to obtain the one or more processed downmix signals.

Moreover, the apparatus comprises an audio scene generator 220 for generating an audio scene comprising a plurality of spatial audio signals based on the one or more processed downmix signals, the parametric audio object information, the additional parametric information, and rendering information. The rendering information indicates a placement of the one or more audio objects in the audio scene. The audio scene generator 220 is configured to attenuate or eliminate an output signal represented by the additional parametric information in the audio scene.

For example, with respect to spatial audio object coding (SAOC) it is well known in the art, how a placement of one or more audio objects can be done based on rendering information, when the one or more audio objects are encoded by one or more processed downmix signals and by parametric audio object information.

According to this embodiment, however, the interface is moreover configured to receive additional parametric information which reflects a processing performed on one or more unprocessed downmix signals to obtain the one or more processed downmix signals. Thus, the additional parametric information reflects the processing as e.g. conducted by an apparatus for encoding according to FIG. 1.

So, in a particular embodiment, the additional parametric information may depend on one or more additional signals, wherein the additional signals indicate a difference between one of the one or more processed downmix signals and one of the one or more unprocessed downmix signals, wherein the one or more unprocessed downmix signals indicate a downmix of the one or more audio objects, and wherein the one or more processed downmix signals result from the processing of the one or more unprocessed downmixed signals.

State-of-the-art decoders, which would receive the processed downmix signals and the encoded signal generated by the apparatus for encoding according to FIG. 1 would not use the additional parametric information comprised by the encoded signal. Instead they would generate the audio scene by only using the processed downmix signals, the parametric audio object information of the encoded signal and the rendering information.

The apparatus for decoding according to the embodiment of FIG. 6, however, uses the additional parametric information of the encoded signal. This allows the apparatus for decoding to undo or to partially undo the processing conducted by the processing module 120 of the apparatus for encoding according to FIG. 1.

The additional parametric information may, for example, indicate a difference signal between one of the unprocessed downmix signals of FIG. 1 and one of the processed downmix signals of FIG. 1. Such a difference signal may be considered as an output signal of the audio scene. For example, each of the processed downmix signals may be considered as a combination of one of the unprocessed downmix signals and a difference signal.

The audio scene generator 220 may then, for example, be configured to attenuate or eliminate this output signal in the audio scene, so that only the unprocessed downmix signal is replayed, or so that the unprocessed downmix signal is replayed and the difference signal is only partially be replayed, e.g. depending on the rendering information.

Figure 7:
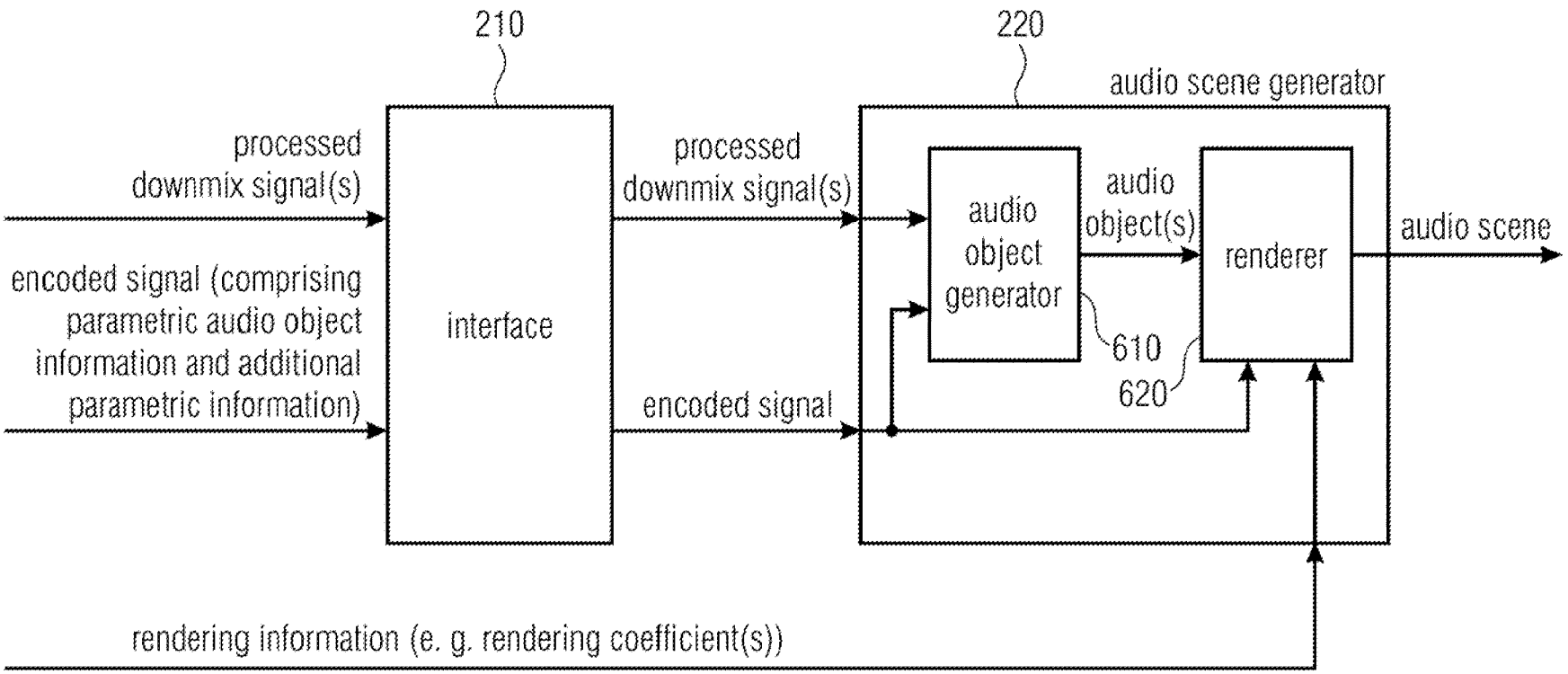
FIG. 7 illustrates an apparatus for decoding an encoded signal according to another embodiment.

FIG. 7 illustrates an apparatus for decoding an encoded signal according to another embodiment. The audio scene generator 220 comprises an audio object generator 610 and a renderer 620.

The audio object generator 610 is configured to generate the one or more audio objects based on the one or more processed downmix signals, the parametric audio object information and the additional parametric information.

The renderer 620 is configured to generate the plurality of spatial audio signals of the audio scene based on the one or more audio objects, the parametric audio object information and rendering information.

According to an embodiment, the renderer 620 may, for example, be configured to generate the plurality of spatial audio signals of the audio scene based on the one or more audio objects, the additional parametric information, and the rendering information, wherein the renderer 620 may be configured to attenuate or eliminate the output signal represented by the additional parametric information in the audio scene depending on one or more rendering coefficients comprised by the rendering information.

Figure 8:
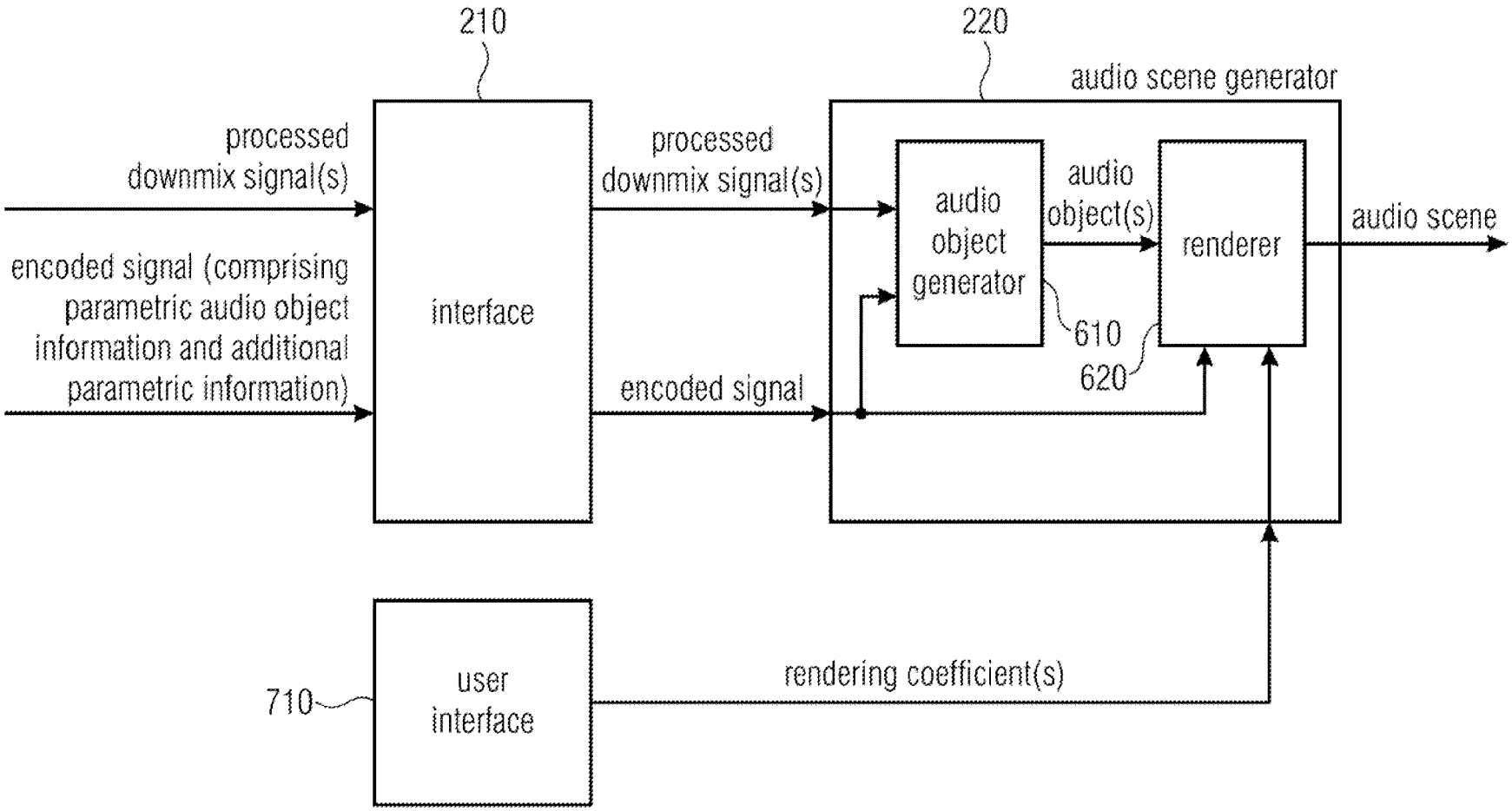
FIG. 8 illustrates an apparatus for decoding an encoded signal according to a further embodiment.

FIG. 8 illustrates an apparatus for decoding an encoded signal according to a further embodiment. In FIG. 8, the apparatus furthermore comprises a user interface 710 for setting the one or more rendering coefficients for steering whether the output signal represented by the additional parametric information is attenuated or eliminated in the audio scene. For example, the user interface may enable the user to set one of the rendering coefficients to 0.5 indicating that an output signal represented by the additional parametric information is partially suppressed. Or, for example, the user interface may enable the user to set one of the rendering coefficients to 0 indicating that an output signal represented by the additional parametric information is completely suppressed. Or, for example, the user interface may enable the user to set one of the rendering coefficients to 1 indicating that an output signal represented by the additional parametric information is not suppressed at all.

According to an alternative embodiment, the audio scene generator 220 may be configured to generate the audio scene comprising a plurality of spatial audio signals based on the one or more processed downmix signals, the parametric audio object information, the additional parametric information, and rendering information indicating a placement of the one or more audio objects in the audio scene, wherein the audio scene generator may be configured to not generate the one or more audio objects to generate the audio scene.

Figure 9:
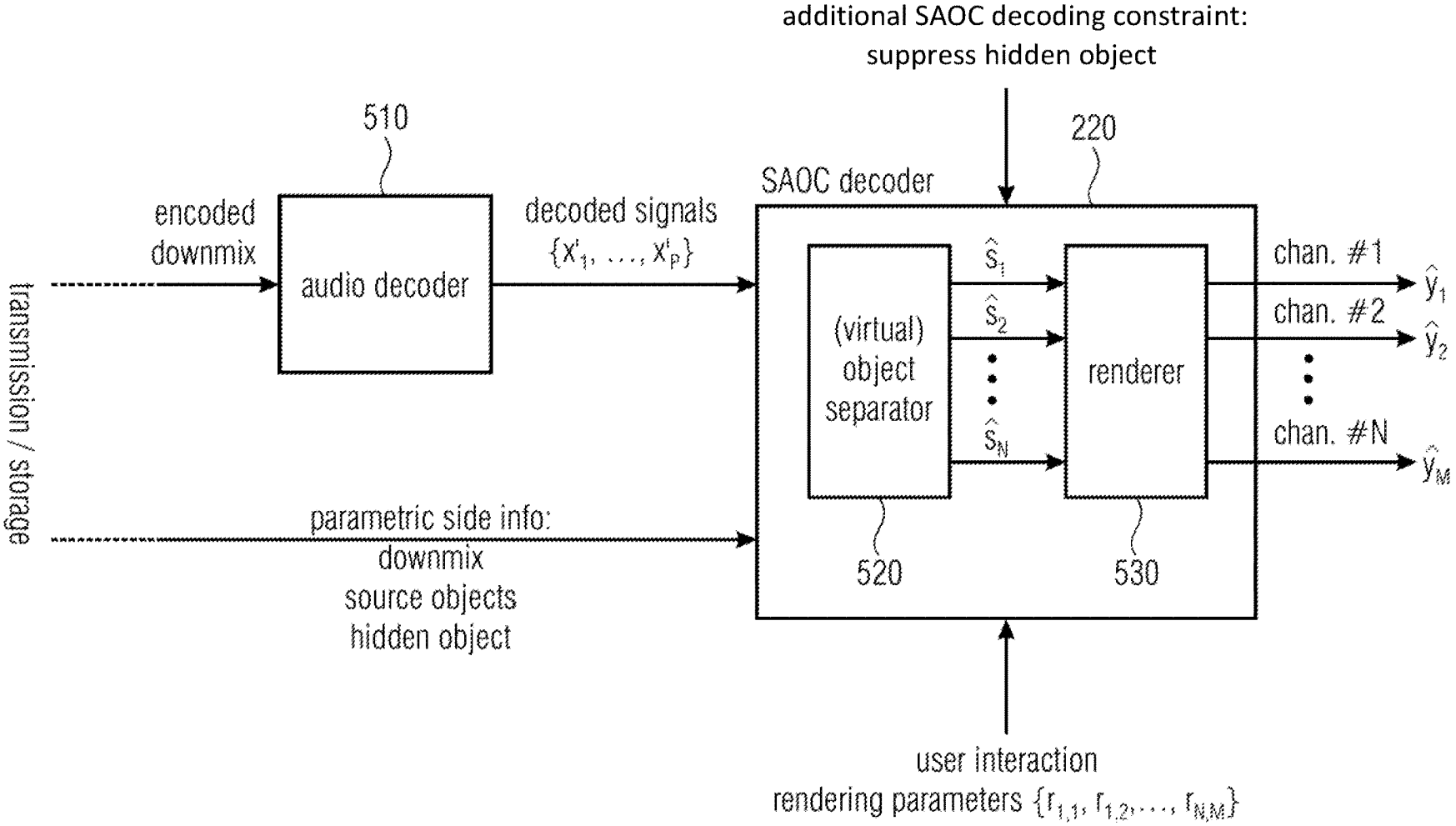
FIG. 9 illustrates an apparatus for decoding an encoded signal according to another embodiment.

FIG. 9 illustrates an apparatus for decoding an encoded signal according to another embodiment. In an embodiment of FIG. 9, the apparatus furthermore comprises an audio decoder 510 for decoding the one or more processed downmix signals (referred to as "encoded downmix") to obtain one or more decoded signals, wherein the audio scene generator is configured to generate the audio scene comprising the plurality of spatial audio signals based on the one or more decoded signals, the parametric audio object information, the additional parametric information, and the rendering information.

In the apparatus of FIG. 9, the apparatus moreover comprises an audio decoder 510 for decoding the one or more processed downmix signals, which are fed from the interface (not shown) into the decoder 510. The resulting decoded signals are then fed into the audio object generator (in FIG. 9 referred to as virtual object separator 520) of an audio scene generator 220, which is, in the embodiment of FIG. 9 a SAOC decoder. The audio scene generator 220 furthermore comprises the renderer 530.

In particular, FIG. 9 illustrates a corresponding SAOC decoding/rendering with hidden object suppression according to an embodiment.

In FIG. 9, the additional side information, e.g. of the encoder of FIG. 4, can be used at the decoding side, e.g. by the decoder of FIG. 9, to suppress the coding noise, thus improving the perceived quality of the rendered acoustic scene. More specifically, this can be done as follows:

1) The additional hidden object information, is incorporated as additional object in the (virtual) object separation process. The coding error is treated the same way as a "regular" audio source object. The additional object may be represented as part of the additional parametric information.
2) Each of the N audio objects is separated out of the mixture by suppressing the N−1 interfering source signals and the coding error signals $q_1 \ldots q_P$. This results in an improved estimation of the audio object signals compared to the case when only the regular (non-hidden) audio (source) objects are considered in this step. Note, that an estimation of the coding error can be computed in the same way.
3) The desired audio scene (also referred to as "acoustic target scene") is generated by rendering the improved audio source estimations $\hat{s}_1, \ldots, \hat{s}_n$ by multiplying the estimated audio object signals with the according rendering coefficients. Any additionally computed estimated coding error signals are omitted in the rendering process.

In practice, in a system like MPEG-D SAOC the second and third step may be carried out in a single efficient transcoding process.

In other embodiments, the hidden audio object concept can also be utilized to undo or control certain audio effects at the decoder side which are applied to the signal mixture at the encoder side. Any effect applied on the downmix channels can cause a degradation of the object separation process at the decoder. Cancelling this effect, e.g. undoing the applied audio effect, from the downmix signals on the decoding side improves the performance of the separation step and thus improves the perceived quality of the rendered acoustic scene. For a more continuous type of operation, the amount of effect that appears in the rendered audio output can be controlled by controlling the rendering level of the hidden object in the SAOC decoder. Rendering the hidden object (which is represented by the additional parametric information) with a level of zero results in almost total suppression of the applied effect in the rendered output signal. Rendering the hidden object with a low level results in a low level of the applied effect in the rendered output signal.

As an example, application of a reverberator to the downmix channels can be undone by transmitting a parameterized version of the reverberation as a hidden (effects) object and applying regular SAOC decoding rendering with a reproduction level of zero for the hidden (effects) object.

More specifically, this can be done as follows:

At the encoder side, an audio effect (e.g. reverberator) is applied to the downmix signals $x_1 \ldots x_P$ resulting in a modified downmix signal $x'_1 \ldots x'_P$.

The processed and time-aligned downmix signals $x'_1 \ldots x'_P$ are subtracted from the unprocessed (original) downmix signals $x_1 \ldots x_P$, resulting in the reverberation signals $q_1 \ldots q_P$ (effect signals).

The effect signals $q_1 \ldots q_P$ and the effect signal mixing parameters $d_{q,1}, \ldots d_{q,P}$ are provided to the object analysis part of the SAOC encoder resulting in the parameter info of the additional (hidden) effect object.

A parameterized description of the effect signal is derived and added as additional hidden (effects) object info to the side info generated by the SAOC side info estimator resulting in an enriched side info transmitted/stored.

At the decoder side, the hidden object information is incorporated as additional object in the (virtual) object separation process. The hidden object (effect signal) is treated the same way as a "regular" audio source object.

Each of the N audio objects is separated out of the mixture by suppressing the N−1 interfering source signals and the effect signals $q_1 \ldots q_P$. This results in an improved estimation of the original audio object signals compared to the case when only the regular (non-hidden) audio source objects are considered in this step. Additionally, an estimation of the reverberation signal can be computed in the same way.

The desired acoustic target scene is generated by rendering the improved audio source estimations $\hat{s}_1, \ldots, \hat{s}_n$ by multiplying the estimated audio object signals with the according rendering coefficients. The hidden object (reverberation signal) can be almost totally suppressed (by rendering the reverberation signal with a level of zero) or, if desired, applied with a certain level by setting the rendering level of the hidden (effects) object accordingly.

In other embodiments, the audio object generator 520 may pass information on the hidden object $\hat{h}$ to the renderer 530.

Thus, in such an embodiment, the audio object generator 520 uses the hidden object side information for two purposes:

On the one hand, the audio object generator 520 uses the hidden object side information for reconstructing the original spatial audio objects $\hat{s}_1, \ldots, \hat{s}_n$. Such original spatial audio objects $\hat{s}_1, \ldots, \hat{s}_n$ then do not reflect the modifications of the downmix signals $x_1, \ldots, x_P$ conducted on the encoder side, e.g. by an audio effect module.

On the other hand, the audio object generator 520 passes the hidden object side information that comprises information about the encoder-side (e.g. intentional) modifications of the downmix signals $x_1, \ldots, x_P$ to the renderer 530, e.g. as a hidden object $\hat{h}$ which the audio object renderer may receive as the hidden object side information.

The renderer 530 may then control whether or not the received hidden object $\hat{h}$ is rendered in the sound scene. The renderer 530 may moreover be configured to control the amount of the audio effect in the one or more audio channels depending on a rendering level of the audio effect. For example, the renderer 530 may receive control information which provides a rendering level of the audio effect.

For example, the renderer 530 may be configurable to control the amount of such that a rendering level of the one or more combination signals is configurable. The rendering level may indicate to which degree the renderer 530 renders the combination signals, e.g. the difference signals that represent the acoustic effect applied on the encoder-side, being indicated by the hidden object side information. For example, a rendering level of 0 may indicate that the combination signals are completely suppressed, while a rendering level of 1 may indicate that the combination signals are not at all suppressed. A rendering level s with $0<s<1$ may indicate that the combination signals are partially suppressed.

In the following, hidden object handling for the example of SAOC is explained. It should be noted that information on hidden objects may be considered as additional parametric information.

At first, terms and definitions are introduced:

S matrix of N original audio object signals (N rows) (representing the above-described audio objects)

$\hat{S}$ matrix of N estimated original audio object signals (N rows)

X matrix of P unprocessed downmix channels (P rows) (representing the above-described downmix signals)

X' matrix of P processed downmix channels (P rows) (representing the above-described processed signals)

Y matrix of M rendered output channels (M rows); using the original source signals $\hat{Y}$ matrix of M rendered output channels (M rows); using the estimated source signals D downmix matrix of size P times N G source estimation matrix of size N times P $OLD_i$ energy of source object (one of the spatial audio objects) $s_i$, i=I, . . . N; computed as defined in SAOC $IOC_{i,j}$ cross correlation between source object (one of the spatial audio objects) $s_i$, and $s_j$, i, j=I, . . . N; computed as defined in SAOC R rendering matrix of size M times N Estimation of the object source $s_1, \ldots, S_N$ within SAOC without using hidden object side information (a kind of additional parametric information), e.g. without consideration of hidden objects, may be conducted as follows:

$$G=ED^T(DED^T)^{-1} \text{ with: } E_{i,j}=IOC_{i,j}\sqrt{OLD_i OLD_j}$$

$$\hat{S}=GX'=ED^T(DED^T)^{-1}X'$$

This yields the best estimation of the original source (spatial audio object) $s_1, \ldots, s_N$ in a least minimum square error sense only for the case that X is equal to X'.

If $X' \neq X$, e.g. due to coding/compression of the downmix or reverberation applied to the downmix, the estimation does not yield the best possible estimation of the original sources.

The desired target scene may be computed as:

$$\hat{Y}=R\hat{S}$$

Now, estimation with using hidden object side information (a kind of additional parametric information), e.g. estimation of the object source $s_1, \ldots, s_N$ under consideration of downmix alterations as hidden objects according to an embodiment is considered.

If the signal alterations (coding, reverberation effect) are considered in the separation process, an improved estimation of original sources $s_1, \ldots, s_N$ can be conducted.

Within SAOC, these alterations can, in its simplest form, be interpreted as additional hidden objects in the downmix and considered in the source estimation process.

Computation with using hidden object side information, e.g. for the example of one hidden object which consists of P signal channels, is now considered. For this purpose, some additional terms and definitions are introduced.

G' source estimation matrix of size (N+P) times P; considering original sources and hidden objects, $OLD'_i$ energy of original sources and hidden object $s_i$, i=1, . . . (N+P); computed as defined in SAOC, $IOC'_{i,j}$ cross correlation between all objects (original sources and hidden objects) $s_i$, and $s_j$, i, j=1, . . . (N+P); computed as defined in SAOC.

Note: cross-correlation between original sources and hidden objects can be for most cases assumed to be zero and had not to be computed, D' downmix matrix of size M times (N+P), describing mixing coefficients of the original sources and hidden objects, which are 1 for default for the hidden objects (e.g. the downmix related information), $\hat{S}'$ matrix of estimated original audio object and hidden object signals of size (N+P), R' rendering matrix of size M times (N+P).

The improved estimation of the original sources $s_1 \ldots s_N$ may be computed as:

$$G'=E'D'^T(D'E'D'^T)^{-1} \text{ with: } E'_{i,j}=IOC'_{i,j}\sqrt{OLD'_i OLD'_j}$$

$$\hat{S}'=G'X'$$

This yields an improved estimation of the original source objects $s_1 \ldots s_N$.

Unlike the default processing, signal parts from the hidden objects are suppressed in the estimations $\hat{s}'_1 \ldots \hat{s}'_N$ of the original sources. Note, that this yields also an estimation of the hidden object.

The desired target scene may then be computed as follows:

$$\hat{Y}=R'\hat{S}'$$

Depending on the application scenario:

the hidden objects can be omitted from the rendering by setting the according rendering coefficients in R' to zero (this would be the default scenario for suppressing coding noise from coding the downmix signal) or rendered with a level unequal zero.

For example, rendering the hidden object with a low level results in a low level of the hidden object (e.g. reverb) in the rendered output signal.

Figure 10:
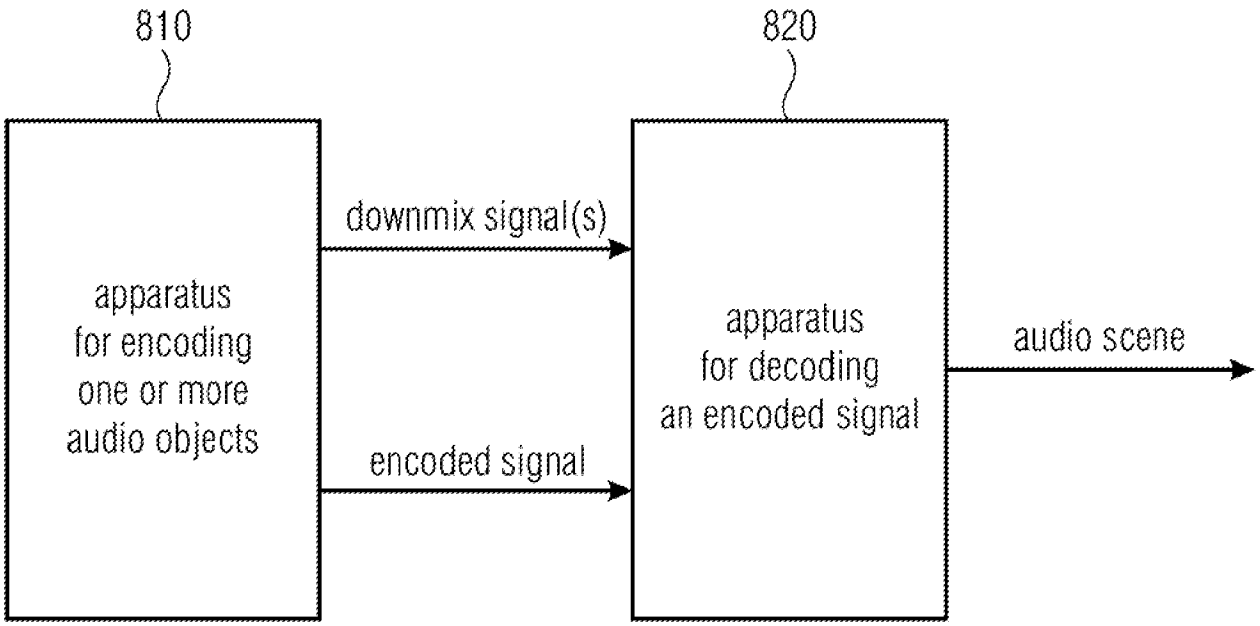
FIG. 10 illustrates a system according to an embodiment.
Figure 11:
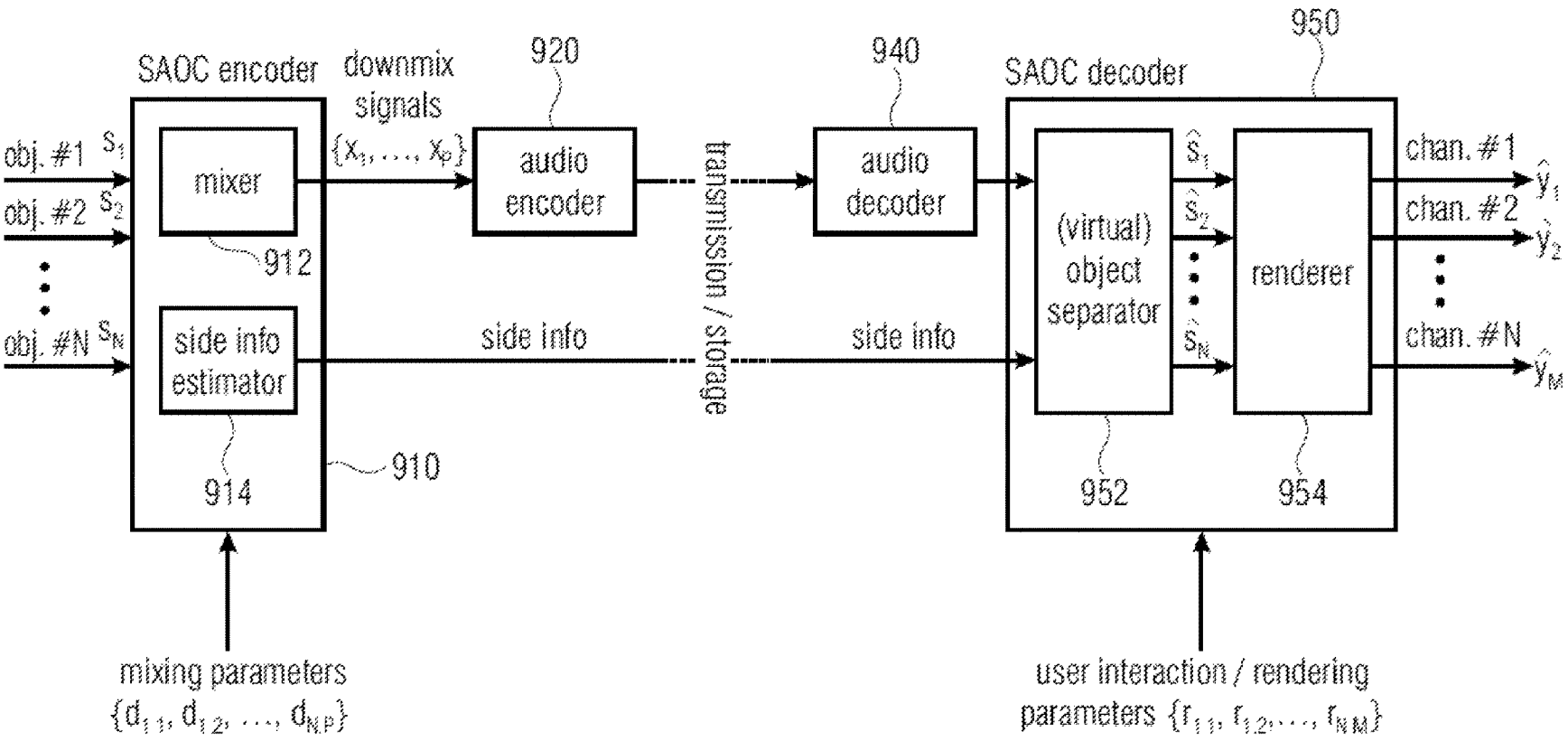
FIG 11 (PRIOR ART)
FIG. 11 illustrates a system according to the state of the art illustrating the example of MPEG SAOC.

FIG. 10 illustrates a system according to an embodiment. The system comprises an apparatus for encoding one or more audio objects 810 according to one of the above-described embodiments, and an apparatus for decoding an encoded signal 820 according to one of the above-described embodiments.

The apparatus for encoding 810 is configured to provide one or more processed downmix signals and an encoded signal to the apparatus for decoding 820, the encoded signal comprising parametric audio object information for one or more audio objects and additional parametric information for one or more additional signals. The apparatus for decoding 820 is configured to generate an audio scene comprising a plurality of spatial audio signals based on the parametric audio object information, the additional parametric information, and rendering information indicating a placement of the one or more audio objects in the audio scene.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[BCC] C. Faller and F. Baumgarte, "Binaural Cue Coding—Part II: Schemes and applications," IEEE Trans. on Speech and Audio Proc., vol. 11, no. 6, November 2003

[JSC] C. Faller, "Parametric Joint-Coding of Audio Sources", 120th AES Convention, Paris, 2006

[SAOC1] J. Herre, S. Disch, J. Hilpert, O. Hellmuth: "From SAC To SAOC—Recent Developments in Parametric Coding of Spatial Audio", 22nd Regional UK, AES Conference, Cambridge, UK, April 2007

[SAOC2] J. Engdegård, B. Resch, C. Falch, O. Helmuth, J. Hilpert, A. Hölzer, L. Terentiev, J. Breebaart, J. Koppens, E. Schuijers and W. Oomen: "Spatial Audio Object Coding (SAOC)—The Upcoming MPEG Standard on Parametric Object Based Audio Coding", 124th AES Convention, Amsterdam 2008

[SAOC] ISO/IEC, "MPEG audio technologies—Part 2: Spatial Audio Object Coding (SAOC)," ISO/IEC JTCI/SC29/WG1 I (MPEG) International Standard 23003-2.

[ISS1] M. Parvaix and L. Girin: "Informed Source Separation of underdetermined instantaneous Stereo Mixtures using Source Index Embedding", IEEE ICASSP, 2010

[ISS2] M. Parvaix, L. Girin, J.-M. Brossier: "A watermarking-based method for informed source separation of audio signals with a single sensor", IEEE Transactions on Audio, Speech and Language Processing, 2010

[ISS3] A. Liutkus and J. Pine! and R. Badeau and L. Girin and G. Richard: "Informed source separation through spectrogram coding and data embedding", Signal Processing Journal, 2011

[ISS4] A. Ozerov, A. Liutkus, R. Badeau, G. Richard: "Informed source separation: source coding meets source separation", IEEE Workshop on Applications of Signal Processing to Audio and Acoustics, 2011

[ISS5] Shuhua Zhang and Laurent Girin: "An Informed Source Separation System for Speech Signals", INTERSPEECH, 2011

[ISS6] L. Girin and J. Pinel: "Informed Audio Source Separation from Compressed Linear Stereo Mixtures", AES 42nd International Conference: Semantic Audio, 2011

The invention claimed is:

1. An apparatus for encoding one or more audio objects to obtain an encoded signal, wherein the apparatus comprises:

a downmixer configured for downmixing the one or more audio objects to obtain one or more unprocessed downmix signals, a processing module configured for processing the one or more unprocessed downmix signals to obtain one or more processed downmix signals, wherein the processing module is configured to process the one or more unprocessed downmix signals by encoding the one or more unprocessed downmix signals to obtain the one or more processed downmix signals, a signal calculator configured for calculating one or more additional signals, wherein the signal calculator comprises a decoding unit and a combiner, wherein the decoding unit is configured to decode the one or more processed downmix signals to obtain one or more decoded signals, and wherein the combiner is configured to generate each of the one or more additional signals by generating a difference signal between one of the one or more decoded signals and one of the one or more unprocessed downmix signals, an object information generator for generating parametric audio object information for the one or more audio objects and additional parametric information for the one or more additional signals, and an output interface for outputting the encoded signal, the encoded signal comprising the parametric audio object information for the one or more audio objects and the additional parametric information for the one or more additional signals.

2. An apparatus according to claim 1, wherein each of the one or more unprocessed downmix signals comprises a plurality of first signal samples, each of the first signal samples being assigned to one of a plurality of points-in-time, wherein each of the one or more decoded signals comprises a plurality of second signal samples, each of the second signal samples being assigned to one of the plurality of points-in-time, and wherein the signal calculator furthermore comprises a time alignment unit being configured to time-align one of the one or more decoded signals and one of the one or more unprocessed downmix signals, so that one of the first signal samples of said unprocessed downmix signal is assigned to one of the second signal samples of said decoded signal, said first signal sample of said unprocessed downmix signal and said second signal sample of said decoded signal being assigned to the same point-in-time of the plurality of points-in-time.

3. An apparatus according to claim 1, wherein the processing module comprises an acoustic effect module and an encoding module, wherein the acoustic effect module is configured to apply an acoustic effect on at least one of the one or more unprocessed downmix signals to obtain one or more acoustically adjusted downmix signals, and wherein the encoding module is configured to encode the one or more acoustically adjusted downmix signals to obtain the one or more processed downmix signals.

4. A system comprising:

the apparatus according to claim 1, and an apparatus for decoding, wherein the apparatus according to claim 1 is configured to provide the one or more processed downmix signals and the encoded signal to the apparatus for decoding, wherein the apparatus for decoding is configured to decode the encoded signal, wherein the apparatus for decoding comprises an interface for receiving the one or more processed downmix signals, and for receiving the encoded signal, and wherein the apparatus for decoding comprises an audio scene generator for generating an audio scene comprising a plurality of spatial audio signals based on the one or more processed downmix signals, the parametric audio object information, the additional parametric information, and rendering information indicating a placement of the one or more audio objects in the audio scene, wherein the audio scene generator is configured to attenuate or eliminate an output signal represented by the additional parametric information in the audio scene.

5. The system according to claim 4, wherein the additional parametric information depends on the one or more additional signals, wherein the additional signals indicate a difference between one of the one or more processed downmix signals and one of the one or more unprocessed downmix signals, wherein the one or more unprocessed downmix signals indicate a downmix of the one or more audio objects, and wherein the one or more processed downmix signals result from the processing of the one or more unprocessed downmixed signals.

6. The system according to claim 4, wherein the audio scene generator comprises an audio object generator and a renderer, wherein the audio object generator is configured to generate the one or more audio objects based on the one or more processed downmix signals, the parametric audio object information and the additional parametric information, and wherein the renderer is configured to generate the plurality of spatial audio signals of the audio scene based on the one or more audio objects, the parametric audio object information and rendering information.

7. The system according to claim 6, wherein the renderer is configured to generate the plurality of spatial audio signals of the audio scene based on the one or more audio objects, the additional parametric information, and the rendering information, wherein the renderer is configured to attenuate or eliminate the output signal represented by the additional parametric information in the audio scene depending on one or more rendering coefficients comprised by the rendering information.

8. The system according to claim 7, wherein the apparatus further comprises a user interface for setting the one or more rendering coefficients for steering whether the output signal represented by the additional parametric information is attenuated or eliminated in the audio scene.

9. The system according to claim 4, wherein the audio scene generator is configured to generate the audio scene comprising a plurality of spatial audio signals based on the one or more processed downmix signals, the parametric audio object information, the additional parametric information, and rendering information indicating a placement of the one or more audio objects in the audio scene, wherein the audio scene generator is configured to not generate the one or more audio objects to generate the audio scene.

10. The system according to claim 4, wherein the apparatus furthermore comprises an audio decoder for decoding the one or more processed downmix signals to obtain one or more decoded signals, and wherein the audio scene generator is configured to generate the audio scene comprising the plurality of spatial audio signals based on the one or more decoded signals, the parametric audio object information, the additional parametric information, and the rendering information.

11. The system according to claim 4, wherein the audio scene generator is configured to generate the audio scene by employing the formulae $$\hat{Y}=R'\hat{S}',$$

$$\hat{S}'=G'\hat{X}',$$

$$G'=E'D'^{T}(D'E'D'^{T})^{-1}, \text{ and}$$

wherein $\hat{Y}$ is a first matrix indicating the audio scene, wherein $\hat{Y}$ comprises a plurality of rows indicating the plurality of spatial audio signals, wherein R' is a second matrix indicating the rendering information, wherein $\hat{S}'$ is a third matrix, wherein X' is a fourth matrix indicating the one or more processed downmix signals, wherein G' is a fifth matrix, wherein D' is a sixth matrix, being a downmix matrix, and wherein E' is a seventh matrix comprising a plurality of seventh matrix coefficients, wherein the seventh matrix coefficients are defined by the formula:

$$E'_{i,j}=IOC'_{i,j}\sqrt{OLD'_i OLD'_j},$$

wherein $E'_{i,j}$ is one of the seventh matrix coefficients at row i and column j, i being a row index and j being a column index, wherein $IOC'_{i,j}$ indicates a cross correlation value, and wherein $OLD'_i$ indicates a first related energy value, and wherein $OLD'_j$ indicates a second related energy value.

12. An apparatus for encoding one or more audio objects to obtain an encoded signal, wherein the apparatus comprises:

a downmixer for downmixing the one or more audio objects to acquire one or more unprocessed downmix signals, a processing module for processing the one or more unprocessed downmix signals to acquire one or more processed downmix signals, wherein the processing module is configured to process the one or more unprocessed downmix signals by encoding the one or more unprocessed downmix signals to acquire the one or more processed downmix signals, a signal calculator for calculating one or more additional signals, wherein the signal calculator comprises a decoding unit and a combiner, wherein the decoding unit is configured to decode the one or more processed downmix signals to acquire one or more decoded signals, and wherein the combiner is configured to generate each of the one or more additional signals by generating a difference signal between one of the one or more decoded signals and one of the one or more unprocessed downmix signals, an object information generator for generating parametric audio object information for the one or more audio objects and additional parametric information for the one or more additional signals, and an output interface for outputting the encoded signal, the encoded signal comprising the parametric audio object information for the one or more audio objects and the additional parametric information for the one or more additional signals, wherein an audio object energy value is assigned to each one of the one or more audio objects, wherein an additional energy value is assigned to each one of the one or more additional signals, wherein the object information generator is configured to determine a reference energy value, so that the reference energy value is greater than or equal to the audio object energy value of each of the one or more audio objects, and so that the reference energy value is greater than or equal to the additional energy value of each of the one or more additional signals, wherein the object information generator is configured to determine the parametric audio object information by determining an audio object level difference for each audio object of the one or more audio objects, so that said audio object level difference indicates a ratio of the audio object energy value of said audio object to the reference energy value, or so that said audio object level difference indicates a difference between the reference energy value and the audio object energy value of said audio object, and wherein the object information generator is configured to determine the additional object information by determining an additional object level difference for each additional signal of the one or more additional signals, so that said additional object level difference indicates a ratio of the additional energy value of said additional signal to the reference energy value, or so that said additional object level difference indicates a difference between the reference energy value and the additional energy value of said additional signal.

13. A method for encoding one or more audio objects to obtain an encoded signal, wherein the method comprises:

downmixing the one or more audio objects to obtain one or more unprocessed downmix signals, processing the one or more unprocessed downmix signals to obtain one or more processed downmix signals, wherein processing the one or more unprocessed downmix signals is conducted by encoding the one or more unprocessed downmix signals to obtain the one or more processed downmix signals, calculating one or more additional signals by decoding the one or more processed downmix signals to obtain one or more decoded signals, and by generating each of the one or more additional signals by generating a difference signal between one of the one or more decoded signals and one of the one or more unprocessed downmix signals, generating parametric audio object information for the one or more audio objects and additional parametric information for the one or more additional signals, and outputting the encoded signal, the encoded signal comprising the parametric audio object information for the one or more audio objects and the additional parametric information for the one or more additional signals.

14. A non-transitory computer-readable medium comprising a computer program configured to implement the method of claim 13 when being executed on a computer or signal processor.

* * * * *